US008925747B1

(12) United States Patent
Hanley

(10) Patent No.: US 8,925,747 B1
(45) Date of Patent: Jan. 6, 2015

(54) SPRING TENSION ROD ASSEMBLY

(76) Inventor: Michael P. Hanley, Smithfield, RI (US)

( * ) Notice: Subject to any disclaimer, the term of this patent is extended or adjusted under 35 U.S.C. 154(b) by 318 days.

(21) Appl. No.: 12/636,138

(22) Filed: Dec. 11, 2009

Related U.S. Application Data

(60) Provisional application No. 61/121,961, filed on Dec. 12, 2008.

(51) Int. Cl.
*A47H 1/08* (2006.01)
*A47H 1/022* (2006.01)

(52) U.S. Cl.
CPC ..... *A47H 1/022* (2013.01)
USPC ..... 211/105.6

(58) Field of Classification Search
CPC ..... A47H 1/02; A47H 1/022; A47H 1/03; A47H 1/06; A47H 1/08; A47H 1/18; A47H 1/19; A47H 1/10; A47H 1/102; A47H 1/04; A47H 1/12; A47H 1/22; A47H 1/24; A47H 1/13; A47H 1/14; A47H 1/142; A47H 1/144; A47H 1/16; A47H 13/00; A47H 15/00; A47H 15/02; A47H 15/04; A47H 5/14; A47H 7/02; A47H 2001/0205; A47H 2001/00; A47H 2001/003; A47H 2001/006; A47H 2001/02; A47H 2001/021; A47H 2001/0215; A47H 2001/04; A47H 2001/042; A47H 2001/045; A47H 2001/047; A47K 10/04; A47K 3/38; A47K 10/12; A47K 10/10; A47G 25/0692; F16B 9/00; F16B 9/02; F16B 9/023; F16B 9/026; A47B 61/003; A47B 45/00; E06B 9/02; E06B 9/50; E06B 9/323; E04F 11/1804
USPC ..... 211/105.1–105.6, 123; 160/330, DIG. 6; 16/87.4 R; 248/252, 265, 251, 261
See application file for complete search history.

(56) References Cited

U.S. PATENT DOCUMENTS

| | | | | | |
|---|---|---|---|---|---|
| 536,272 | A | * | 3/1895 | Edsall | 211/105.6 |
| 1,023,650 | A | * | 4/1912 | Hovagimian | 211/105.6 |
| 1,036,813 | A | * | 8/1912 | Edsall | 403/305 |
| 1,425,247 | A | * | 8/1922 | Galbreath | 211/105.6 |
| 1,500,049 | A | * | 7/1924 | Brooks | 211/105.6 |
| 1,639,551 | A | * | 8/1927 | Booth | 211/105.6 |
| 2,032,842 | A | * | 3/1936 | Gould | 211/105.6 |
| 2,253,664 | A | * | 8/1941 | Vigo | 242/599.1 |
| 2,307,095 | A | * | 1/1943 | Zaferakis | 160/263 |
| 2,519,996 | A | * | 8/1950 | Blake | 211/105.6 |
| 2,649,971 | A | * | 8/1953 | Marchand | 211/123 |
| 2,973,870 | A | * | 3/1961 | Schoos | 211/123 |
| 2,988,135 | A | * | 6/1961 | Caminiti | 296/64 |
| 4,118,087 | A | * | 10/1978 | Dorf | 312/291 |
| 4,147,199 | A | * | 4/1979 | Cameron | 160/330 |
| 4,373,569 | A | * | 2/1983 | Barettella | 160/263 |
| 4,492,263 | A | * | 1/1985 | Gebhard | 160/228 |
| 5,011,030 | A | * | 4/1991 | Alaurent | 211/105.6 |
| RE33,913 | E | * | 5/1992 | Kral et al. | 211/59.2 |

(Continued)

*Primary Examiner* — Jennifer E Novosad
(74) *Attorney, Agent, or Firm* — Steven M. McHugh

(57) ABSTRACT

A spring-tension rod assembly is disclosed. The assembly includes an outer rod. A spring having a first portion and a second portion is also included. The first portion of the spring received into the outer rod and fixedly secured therein. An inner rod is received into the outer rod and selectively engages the second portion of the spring. The spring is configured to urge the inner rod out of the outer rod. The inner rod is configured to adjust outwards from the outer rod to a desired length by indexing about the second portion of the spring.

9 Claims, 4 Drawing Sheets

(56) References Cited

U.S. PATENT DOCUMENTS

| | | | | |
|---|---|---|---|---|
| 5,799,346 | A * | 9/1998 | Tiernan | 4/601 |
| 5,881,792 | A * | 3/1999 | Cheng | 160/263 |
| 6,571,426 | B2 * | 6/2003 | Chen | 16/87 R |
| 7,128,124 | B2 * | 10/2006 | Bibby et al. | 160/263 |
| 7,510,152 | B2 * | 3/2009 | Melic | 248/200.1 |
| 8,051,781 | B1 * | 11/2011 | Vind et al. | 108/42 |
| 2011/0297632 | A1 * | 12/2011 | Goldstein | 211/105.6 |

* cited by examiner

SPRING TENSION ROD ASSEMBLY

CROSS-REFERENCE TO RELATED APPLICATION

The present patent document claims priority to earlier filed U.S. Provisional Patent Application Ser. No. 61/121,961, filed on Dec. 12, 2009, the entire contents of which are incorporated herein by reference.

BACKGROUND OF THE INVENTION

1. Field of the Invention

The present patent document relates generally to spring-tension rods used for window curtains and shower curtains in households, and more particularly to an improved spring-tension rod assembly that has improved manufacturing cost.

2. Background of the Related Art

Curtain rods that require no mounting hardware and that are frictionally fit within a window casement, commonly known as spring-tension rods, are known in the art. These rods are desirable to consumers because they require little or no skill or tools to install and installation is frequently damage-free to the window casement.

A larger variation of a spring-tension rod is used to hang shower curtains in a shower or tub stall in a bathroom, and operates in the same manner.

Prior art spring-tension rods include an outer rod an inner rod received within the outer rod. A finial assembly adorns each end of the spring-tension rod and serves as a foot against the window casement and/or wall. A spring is included in the outer rod and one end of the spring held in place by a plastic insert or is crimped in place to the outer rod. The other end of the spring engages the inner rod and biases the inner rod outwardly and away from the outer rod, thereby permitting the spring-tension shade to be mounted within a window casement or, in the case of a spring-tension shower rod, mounted within and bath tub or shower stall.

However, it is desirable to reduce the manufacturing cost and assembly complexity of spring-tension rods. Therefore, there is a perceived need for an improved spring-tension rod that has reduced manufacturing cost and assembly complexity.

SUMMARY OF THE INVENTION

The present invention solves the problems of the prior art by providing an improved spring-tension rod assembly that includes a uniquely shaped spring, and outer rod, and inner rod, a ferrule and a pair of decorative finials. In particular, the spring has an end that includes several closed squared coils followed by several closed tapered coils. The spring also includes a number of open coils. The squared coils of the spring are inserted into the outer rod and form a tight friction fit against the outer rod. The ferrule is inserted into the other open end of the outer rod and serves as guide for the inner rod. The inner rod is inserted through the ferrule and into the outer rod and engages the open coils of the spring. A decorative finial in connected to one end of the outer rod and the inner rod, respectively. By forcing the inner rod into the outer rod, the open coils of the spring are compressed. The spring biases the inner rod away from the outer rod.

BRIEF DESCRIPTION OF THE DRAWINGS

These and other features, aspects, and advantages of the present invention will become better understood with reference to the following description, appended claims, and accompanying drawings where:

DESCRIPTION OF THE PREFERRED EMBODIMENT

Figure 1:
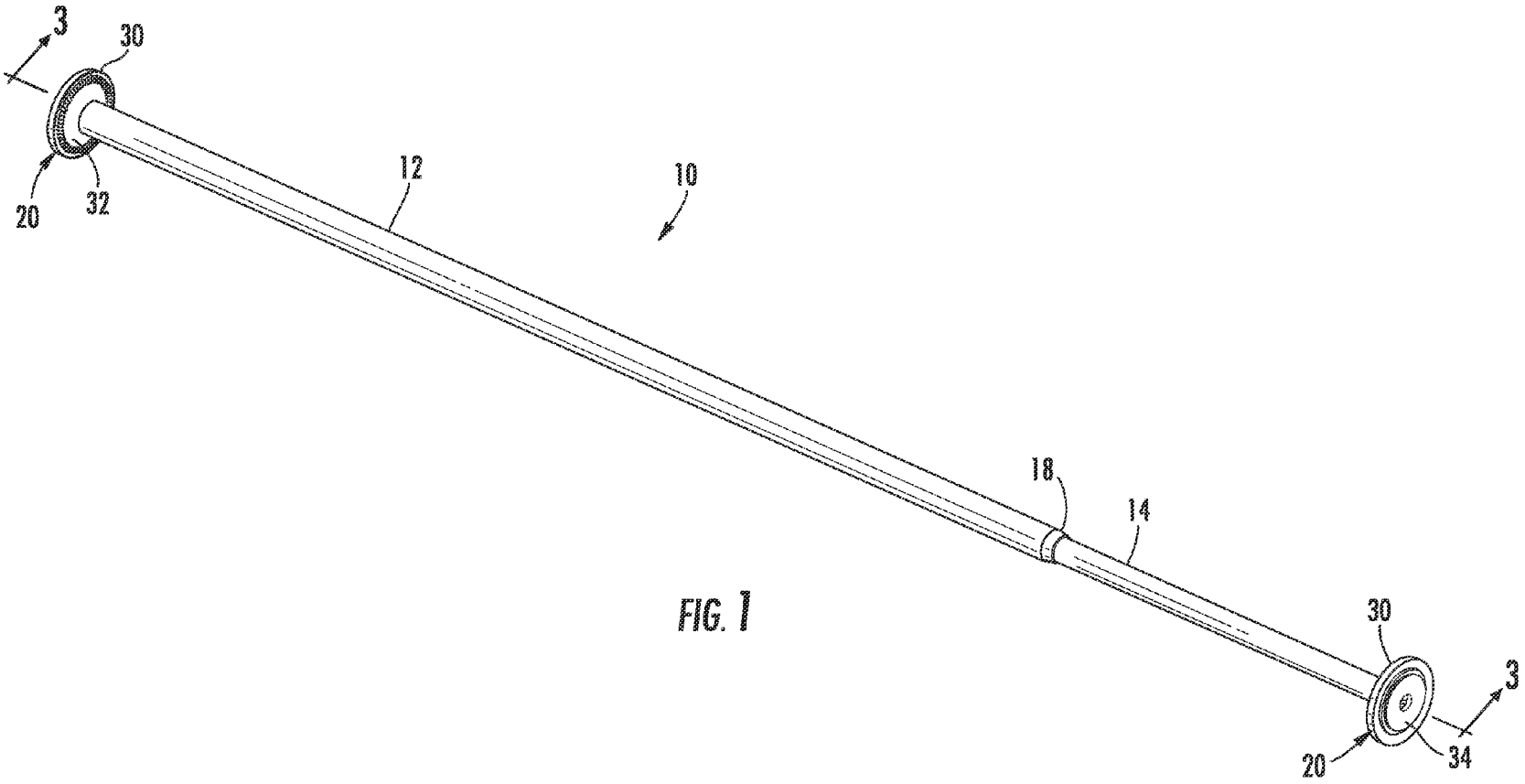
FIG. 1 is a perspective view of the preferred embodiment of the spring-tension rod assembly of the present invention.
Figure 2:
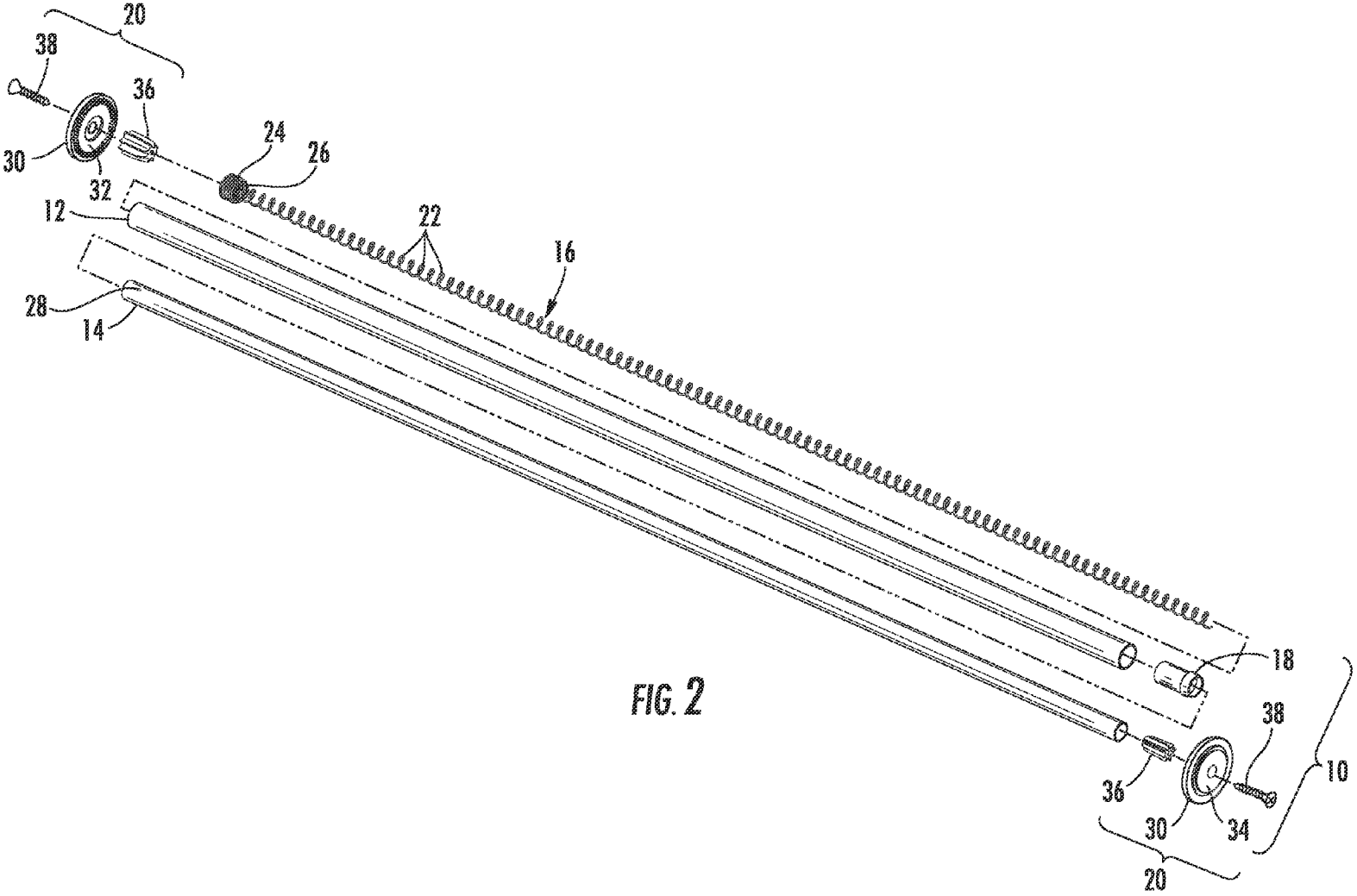
FIG. 2 is an exploded view of the preferred embodiment of the spring-tension rod assembly of the present invention.
Figure 3:
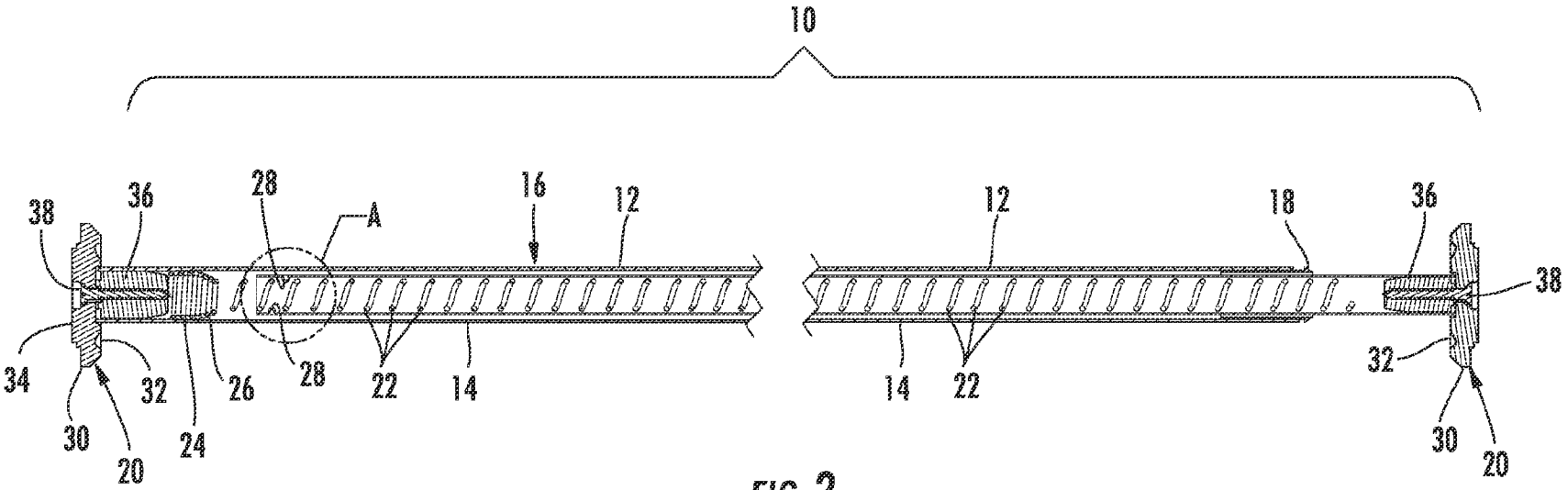
FIG. 3 is a cross-section through line 3-3 of FIG. 1.

Referring now to FIGS. 1-3, the spring-tension rod assembly of the present invention is shown generally at 10. The spring-tension rod assembly 10 includes an outer rod 12, inner rod 14, a spring 16, a ferrule 18 and a pair of decorative finial assemblies 20, all of which will be further described below.

The outer rod 12 and the inner rod 14 are tubes with each having a pair of open ends. The inner rod 14 is of smaller diameter than the outer rod 12 and can slide into the outer rod 12.

Figure 4:
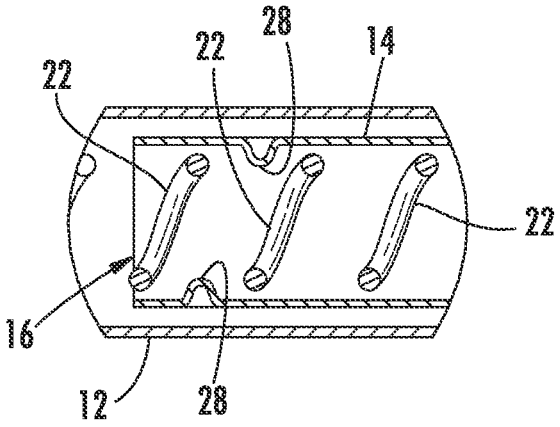
FIG. 4 is a close-up view of Inset A of FIG. 3.
Figure 5:
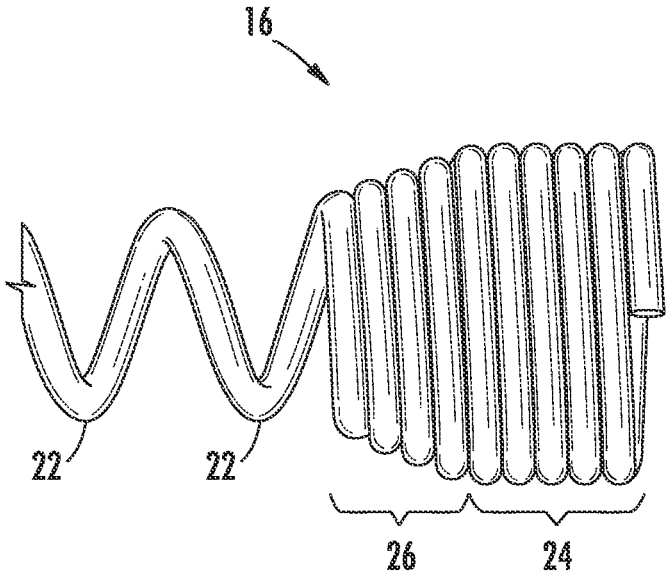
FIG. 5 is a partial side view of the spring used in the preferred embodiment of the spring tension rod assembly of the present invention.

Referring now to FIG. 5, the spring 16 has a body with an end that includes several closed and squared coils 24 followed by several closed tapered coils 26. The body of the spring 16 includes a number of open coils 22 extending from the closed tapered coils 26 at the end of the spring 16. The squared coils 24 on the end of the spring 16 are compressed and the spring 16 is inserted into outer rod 12 as show in FIGS. 3 and 4. Once in the outer rod 12, the end of the spring 16 is released allowing the compressed coils 24 to expand outwardly against the outer rod 12. The squared closed coils 24 of the end of the spring 16 frictionally hold the end of the spring 16 in place within the outer rod 12.

Referring back now to FIGS. 1-3, a ferrule 18 is frictionally fit into the other end of the outer rod 12 and a decorative finial assembly 20, described further below is frictionally fit into the end of the outer rod 12 nearest the end of the spring 16. The ferrule 18 serves as a guide for the inner rod 14.

The inner rod 14 is received through the ferrule 18 and into the outer rod 12. Referring to FIG. 4 (showing Inset A of FIG. 3 more clearly), the inner rod 14 includes a pair of detents 28 projecting inwardly configured to engage the open coils 22 of the body of the spring 16. In particular, the inner rod 12 may be threaded onto the spring 16 thereby making the overall length of the spring-tension rod assembly 10 adjustable. When inward force is applied to the inner rod 14 it slides inwardly into the outer rod 12 and compresses the spring 16. As force is exerted on the open coils 22 of the spring 16, the closed coils 24, 26 exert increasing outward pressure against the outer rod 12, thereby holding the spring 16 firmly in place.

The other decorative finial assembly 20 is frictionally fit into the other end of the inner rod 14.

Each decorative finial assembly 20 includes a base portion 30 with a decorative top 32 and a foot 34, and a bushing 36. The bushing 36 is attached to the base portion 30 with a screw 38. Each bushing 36 is configured to frictionally fit within an end the tubular outer rod 12 and the tubular inner rod 14, respectively. Optionally, the bushings 36 may be replaced with sleeves (not shown) configured to receive either an end the tubular outer rod 12 or the tubular inner rod 14, respectively.

Therefore, it can be seen that the present invention provides a unique solution to the problem of providing an improved spring-tension rod that has reduced manufacturing cost and assembly complexity. In particular, the use of the uniquely configured spring avoids the need to crimp the outer rod or the need for a plastic insert configured to hold the spring. The spring itself can easily be made with a spring winding machine at no additional cost.

It would be appreciated by those skilled in the art that various changes and modifications can be made to the illustrated embodiments without departing from the spirit of the present invention. All such modifications and changes are intended to be within the scope of the present invention.

What is claimed is:

1. A spring-tension rod assembly for a curtain, comprising:

an outer rod having an inner surface;

a spring having a first portion and a second portion, wherein the first portion of the spring has a larger diameter than the second portion of the spring and wherein the first portion of the spring is sized and configured to expand radially outwardly to press against the inner surface of the outer rod to be frictionally secured within the outer rod and;

an inner rod at least partially located within the outer rod and configured to at least partially contain the second portion of the spring, wherein the inner rod includes a plurality of detents configured to threadingly engage the second portion of the spring when the spring is at least partially contained therein;

wherein the spring is configured and arranged to urge the inner rod out of the outer rod; and wherein the inner rod is configured and arranged to adjust outwards from the outer rod a desired length by rotating the inner rod relative to the outer rod.

2. The assembly of claim 1, further comprising a first finial attached to the outer rod and a second finial attached to the inner rod.

3. The assembly of claim 2, wherein the first finial and second finial each further include an outwardly projecting foot.

4. The assembly of claim 1, further comprising a ferrule received into the outer rod and configured to guide the inner rod into the outer rod.

5. The assembly of claim 1, wherein the first portion of the spring includes a plurality of closed coils.

6. The assembly of claim 1, wherein the second portion of the spring includes a plurality of open coils.

7. The assembly of claim 6, wherein the plurality of detents includes a first detent configured to threadably engage the open coils of the second portion of the spring.

8. The assembly of claim 7, wherein the plurality of detents further includes a second detent spaced apart from the first detent, wherein the second detent is configured and arranged to threadably engage the open coils of the second portion of the spring.

9. A spring-tension rod assembly for a curtain, comprising:

an outer rod having an inner surface;

an inner rod configured to be received into the outer rod, wherein the inner rod includes a first detent spaced apart from a second detent;

a spring having a first portion and a second portion, wherein the first portion of the spring has a larger diameter than the second portion of the spring and wherein the first portion of the spring is located within the outer rod and is sized and configured to expand radially outwardly to press against the inner surface of the outer rod to be frictionally secured therein and wherein the second portion of the spring includes a plurality of open coils and is at least partially located within the inner rod;

wherein the first detent and second detent are arranged to threadingly engage the open coils of the second portion of the spring and wherein the spring is configured and arranged to adjust the inner rod out of the outer rod a desired length by rotating the inner rod relative to the outer rod.

* * * * *